US008695547B2

(12) United States Patent
Weinmeister

(10) Patent No.: US 8,695,547 B2
(45) Date of Patent: Apr. 15, 2014

(54) ADJUSTABLE CAMSHAFT

(71) Applicant: Neumayer Tekfor Holding GmbH, Hausach (DE)

(72) Inventor: Roman Weinmeister, Rorschach (CH)

(73) Assignee: Neumayer Tekfor Holding GmbH, Hausach (DE)

( * ) Notice: Subject to any disclaimer, the term of this patent is extended or adjusted under 35 U.S.C. 154(b) by 0 days.

(21) Appl. No.: 13/725,199

(22) Filed: Dec. 21, 2012

(65) Prior Publication Data

US 2013/0104824 A1 May 2, 2013

Related U.S. Application Data

(63) Continuation of application No. PCT/DE2011/001205, filed on Jun. 11, 2011.

(30) Foreign Application Priority Data

Jun. 25, 2010 (DE) ..... 10 2010 025 100

(51) Int. Cl.
*F01L 1/34* (2006.01)

(52) U.S. Cl.
USPC ..... 123/90.16; 123/90.18

(58) Field of Classification Search
USPC ..... 123/90.16, 90.18
See application file for complete search history.

(56) References Cited

U.S. PATENT DOCUMENTS

| | | | |
|---|---|---|---|
| 4,353,334 | A | 10/1982 | Neitz |
| 4,794,893 | A | 1/1989 | Masuda et al. |
| 5,129,407 | A | 7/1992 | Phillips |
| 2005/0205019 | A1 | 9/2005 | Burk et al. |
| 2011/0203541 | A1 | 8/2011 | Meintschel et al. |

FOREIGN PATENT DOCUMENTS

| | | | |
|---|---|---|---|
| DE | 27 37 601 | A1 | 3/1979 |
| DE | 195 19 048 | A1 | 11/1996 |
| DE | 195 20 117 | A1 | 12/1996 |
| DE | 195 49 572 | C2 | 1/2003 |
| DE | 10 2004 055 852 | A1 | 4/2006 |
| DE | 10 2007 016 977 | A1 | 10/2008 |
| GB | 186369 | A | 9/1922 |
| WO | WO 2010/040439 | A1 | 4/2010 |

OTHER PUBLICATIONS

Corresponding International Search Report with English Translation dated Dec. 21, 2011 (seven (7) pages).
German language Office Action dated May 24, 2011 (two (2) pages).

*Primary Examiner* — Zelalem Eshete
(74) *Attorney, Agent, or Firm* — Crowell & Moring LLP

(57) ABSTRACT

An adjustable camshaft having at least one shaft, and having at least one cam package which has at least two different cams and/or cam contours. According to the invention, the cams and/or the cam contours of the cam packages have different widths.

6 Claims, 15 Drawing Sheets a)

b)

a)

b)

c)

ADJUSTABLE CAMSHAFT

CROSS REFERENCE TO RELATED APPLICATIONS

This application is a continuation of international patent application no. PCT/DE2011/001205, filed Jun. 11, 2011, designating the United States of America and published in German on Jan. 19, 2012 as WO 2012/006992, the entire disclosure of which is incorporated herein by reference. Priority is claimed based on Federal Republic of Germany patent application no. DE 10 2010 025 100.3, filed Jun. 25, 2010, the entire disclosure of which is likewise incorporated herein by reference.

BACKGROUND OF THE INVENTION

The invention relates to an adjustable camshaft, having at least one shaft, and having at least one cam package which comprises at least two different cams and/or cam contours.

A camshaft includes at least one support element, also called a tube or shaft, and at least one cam. For applications in engines, camshafts serve as a part of the valve operating mechanism, wherein the support element rotates about its longitudinal axis. The cams convert the rotary movement into longitudinal movements, and the inlet and outlet valves of the motor are controlled by these movements. In order to make it possible to optimally control the engine according to loads present, approaches for the adjustment of camshafts are found in the prior art, for example wherein different cams are made to engage with the valves, or wherein the settings of the cams, e.g. the angles of the cams to each other, are altered. In the patent publication WO 2010/040439 A1, a valve operating mechanism is described wherein a device attached outside of the camshaft enables the displacement of individual pairs of cams or groups of cam pairs, such that the different cam contours of the cam pairs serve the purpose of controlling the valves. The construction described in that document requires a large constructed space around the actual camshaft. In addition, the number of components used is relatively high, which is associated with high complexity.

In the prior art, the adjustment of the camshaft generally requires consideration of the fact that the cams can only be adjusted if the associated valves are running on the base circle of the cams, meaning if the cams are not operating the valves. For this reason, the cams must either be adjusted individually, or groups can be formed only of cams which are not engaged with the valves, at least during a phase. In the latter case, the adjustment of the cams is carried out at that point.

SUMMARY OF THE INVENTION

An object of the invention is to provide an adjustable camshaft which enables a greater range of time points for the adjustment of the camshaft compared to the prior art.

Another object of the invention is to provide an adjustable camshaft which enables different groupings of the cams of different valves and/or cylinders.

These and other object have been achieved in accordance with the present invention by providing an adjustable camshaft in which the cams and/or the cam contours of the cam packages have different widths. An appropriately wide cam and/or a sufficiently wide cam contour can serve the purpose of making it possible for a cam package to be displaced outside of the base circle of a cam as well. As such, it is possible to group cams or cam packages, which for example are axially displaced at the same time, even if a cam is operating a valve at the time.

In one embodiment of the invention, the cam package is designed to be able to slide axially along a longitudinal axis of the camshaft.

In one embodiment of the invention, at least one adjusting element is included which is constructed to be able to slide axially along the longitudinal axis, and the adjusting element is mechanically coupled to the cam package via at least one contact element. In this embodiment, an adjusting element is therefore included which is connected to at least one cam package on the shaft. The cam package and the adjusting element can slide axially along the longitudinal axis of the camshaft, such that a displacement of the adjusting element results in a displacement of the cam package, and the different cams or cam contours of the cam package, or optionally the cam packages, come into contact with the valves.

In one embodiment, the adjusting element is arranged inside the shaft.

In one embodiment of the invention, multiple cam packages are included and are arranged to be able to slide axially on the shaft, and at least two of the cam packages are mechanically coupled to the adjusting element.

In one embodiment of the invention, the shaft is constructed to be able to slide axially along the longitudinal axis of the camshaft. In this embodiment, it is the shaft itself which can slide axially. By means of the cams or cam packages connected to the shaft, it is also therefore possible to alter the control of individual valves by displacing the shaft.

If the shaft can slide axially along the longitudinal axis, and an adjusting element is included which can slide axially, then it is possible to form at least two different groups of cam packages which can be adjusted independently of each other.

In one embodiment of the invention, at least one individual cam and/or one cam package is included which is rigidly connected to the shaft. The cam package in this case can likewise have identical or varying widths.

In one embodiment of the invention, the adjusting element is constructed to be able to rotate radially about the longitudinal axis of the camshaft. With such an embodiment, it is therefore also possible to adjust the angular position, and therefore the phase of the cams.

In one embodiment of the invention, at least one axial adjusting device is included which is connected to the adjusting device and which slides the adjusting element axially, at least in sections thereof.

In one embodiment of the invention, multiple adjusting elements are included which are designed to be able to slide axially along the longitudinal axis of the camshaft. The use of a plurality of adjusting elements accordingly makes it also possible to control and slide multiple cam packages, individually or in groups thereof.

In one embodiment of the invention, the adjusting element is constructed as a solid cylinder or as a tube, or as a segment of a cylinder or a segment of a tube, or as a sheet metal part.

BRIEF DESCRIPTION OF THE DRAWINGS

The invention is described below in greater detail with reference to several illustrative embodiments depicted in the accompanying drawing figures, in which.

DETAILED DESCRIPTION OF EMBODIMENTS

Figure 1:
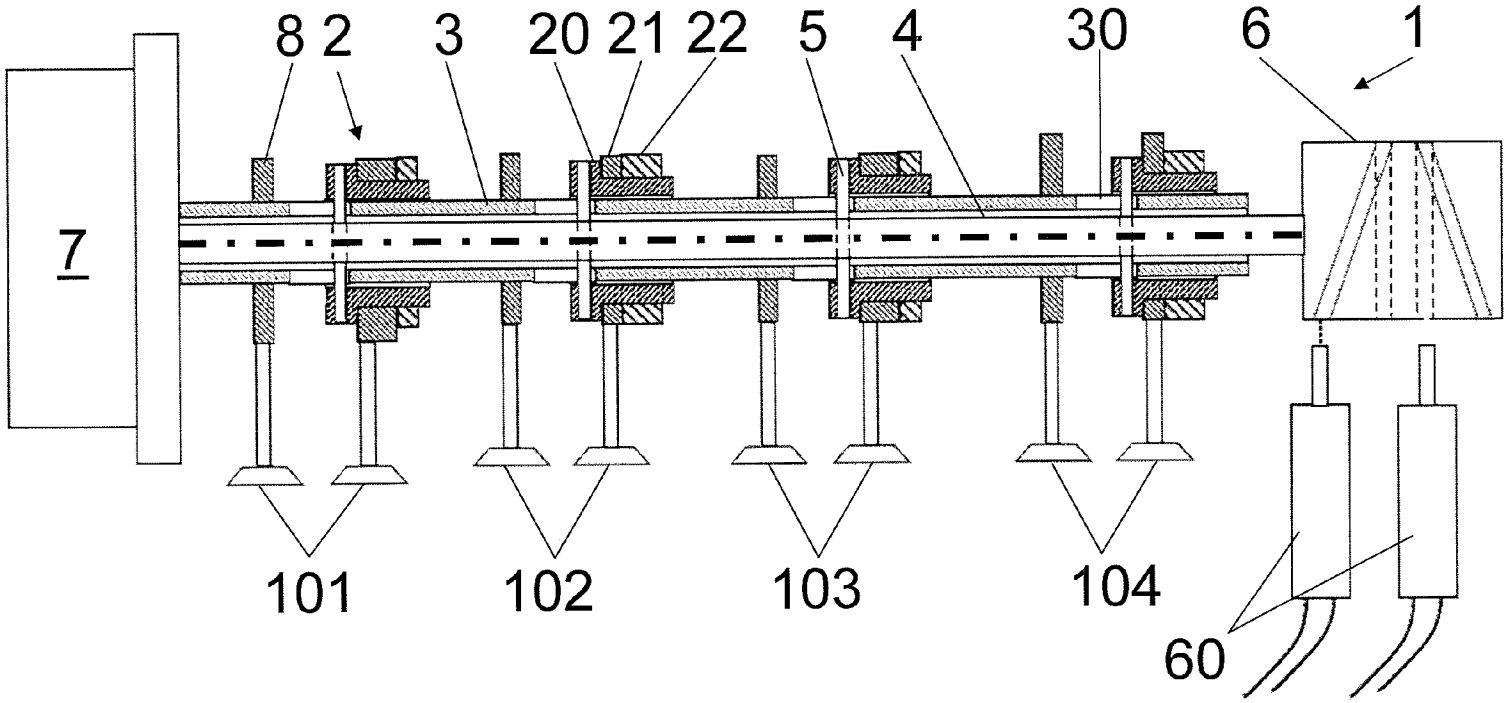
FIG. 1 shows a cutaway view of a schematic camshaft according to the invention at a first point in time.

FIG. 1 illustrates a camshaft 1 according to the invention, intended in this case to control the valves of four cylinders. The invention can also be used in engines having another number of cylinders. Two valves in this case are functionally assigned to each cylinder—not illustrated here—including the valves of the first cylinder 101, the second cylinder 102, the third cylinder 103, and the fourth cylinder 104. In this configuration, one single cam 8 on the camshaft 1 is functionally assigned to each valve—illustrated on the left in this case—said cam being attached to the shaft 3 and fixed in the axial dimension. For each of the other valves—illustrated on the right—one cam package 2 is included which particularly enables a modification of the valve lift.

In a further variant, which is not illustrated here, it is possible for both valves of a cylinder to be controlled differently according to the invention by a modification of the cams. By way of example, the camshaft 1 is illustrated here for the inlet valve of the cylinder. Such a camshaft 1 can also be used accordingly for the outlet valves. The cam packages 2 each have a slot 20 which can slide axially on the shaft 3 along the longitudinal axis—indicated here by a dashed line. In this embodiment, a first cam 21 and a second cam 22 are disposed on the slot 20. The cams 21, 22 differ in regard to their outer profile—for example the height of the prominence or nose which forms the cams, thereby determining the valve lift (see the example of the first cam 21 with the nose 21.1 in FIG. 5).

As an alternative or complementary thereto, the cams 21, 22 have a different profile. In a further embodiment, at least one cam is a single-piece component of the slot 20, meaning that the slot 20 can also have such a cam contour itself. So that the different cams 21, 22 of the cam package 2, and/or the different control profiles associated with the same, become engaged with the respective valves, the axially displaceable slot 20 is connected to an adjusting element 4 in the shaft 3, which has a hollow construction, via a contact element 5, which is by way of example a pin. Recesses 30, for example grooves, are included in the shaft 3 for each of the contact elements 5. In this case, the contact elements 5 extend clear through the adjusting element 4 and/or the shaft 3.

Because the adjusting element 4 itself is designed to be able to slide axially, the cam packages 2 can be slid axially, meaning it is possible to effect a control of the valve by means of the first cam 21 or by means of the second cam 22. By way of example, the adjusting element 4 is a solid shaft which can optionally be made of a plastic or of a composite material. The camshaft 1 is driven by the crankshaft—which is not illustrated here. The torque is divided, in the example shown here, and transmitted via the outside shaft 3 and the single cam 8 rigidly attached to the same, as well as via the adjusting element 4 and the contact element 5. For a coaxial arrangement of the adjusting element 4 in the shaft 3, the configuration includes a corresponding mounting of the adjusting element 4 in the shaft 3, or a corresponding pinned fitting is included.

In the present illustration in FIG. 1, the cam packages 2 of the valves of the second 102 and the fourth cylinders 104 are displaced at the same time. In alternative embodiments, it is also possible to group fewer or more cam packages 2 accordingly. The cams 21, 22 of the cam package 2 have different widths. The first cam 21 in the cam packages 2 for the second and fourth cylinders is narrower than the second cam 22. In contrast, the first cam 21 is wider than the second cam 22 in the cam packages 2 of the first and third cylinders. Due to the greater width of the first cam 21, it is therefore possible for the adjustment to be made for the valve of the first cylinder 101, for example, even if the valve of the first cylinder 101 is at that moment running outside of the base circle, meaning when the cam presses the valve against a spring—for example via a rocker arm—and thereby causing the valve to open. Only once the adjusting element 4 is further displaced, meaning beyond the width of the cam, does the changeover of the cams for the valves of the first 101 and third cylinders 103 occur.

The changeover of a cam package from one cam to the other always occurs on the base circle, meaning when the cam of the associated cam package is not operating the assigned valve—but nevertheless takes place during the time in which a cam of another cam package is operating a valve, meaning outside the base circle for this other cam-valve combination. The arrangement of the wider and/or narrower cams in this case only refers to the example in the illustration, and can be adapted accordingly for the needs of the engine and/or the type of control of the cylinder. By way of example, if the torque is only transmitted from the outside shaft 3—in an implementation which is not illustrated here—then a rotation can additionally occur via the adjusting element 4, such that a phase modification is also possible.

For the purpose of a radial modification—relative to the crankshaft and/or relative to the cams with respect to each other—a radial rotation device 7 is included. The axial displacement of the adjusting element 4 is—in this example—achieved by the axial adjusting device 6, wherein two actuators 60 engage with the same via matching tracks, such that a linear movement of the actuators 60 perpendicular to the longitudinal axis of the adjusting element 4 results in an axial displacement of the adjusting element 4 in the direction of the longitudinal axis. The actuator 60—in this case drawn at the left—generates a leftward movement through the track, and the right actuator 60 generates the return movement. In this and in the following diagrams, the dashed line extending from the actuator 60 is intended to show the position in the track at which the actuator 60 strikes.

As an alternative, it is also possible to achieve a radial rotation of the cam package 2 with respect to the single cams 8, the same being rigidly fixed on the shaft 3, via the radial rotation device 7. The arrangement and construction of the adjusting element 4 in this case is independent of the cams 21, 22 of the cam package 2, said cams 21, 22 having different widths. Accordingly, it is also possible to combine the cams 21, 22 of different widths, and the associated possibility of the displacement outside of the base circle, with other implementations of the adjustment. This also applies in the following examples. In the same way, the combination of the cam packages with a special design in this case, with the already illustrated variants, and the following variants of the adjustment, constitutes an optimization of the adjustment.

FIG. 1 illustrates the time segment and the manner in which—referring to the camshaft for the inlet valves (the same configuration can be realized for other camshafts as well)—a disengagement of one valve for each of the second and fourth cylinders is initiated. In this case, the adjusting element 4 is displaced axially to such a degree that the valves 102, 104 are no longer in contact with the first cam 21 in each case, but rather with the second cam 22. In the example shown here, the actuator 60—shown at left in the drawing—is disposed in this case at the start of the track which effects the axial displacement. The second cam 22 in the illustrated variant is designed in such a manner that it results in a disengagement of the associated valve because the valve at this point is only running on the base circle of the—noseless or pointless—cam 22, and is therefore not being operated.

Figure 2:
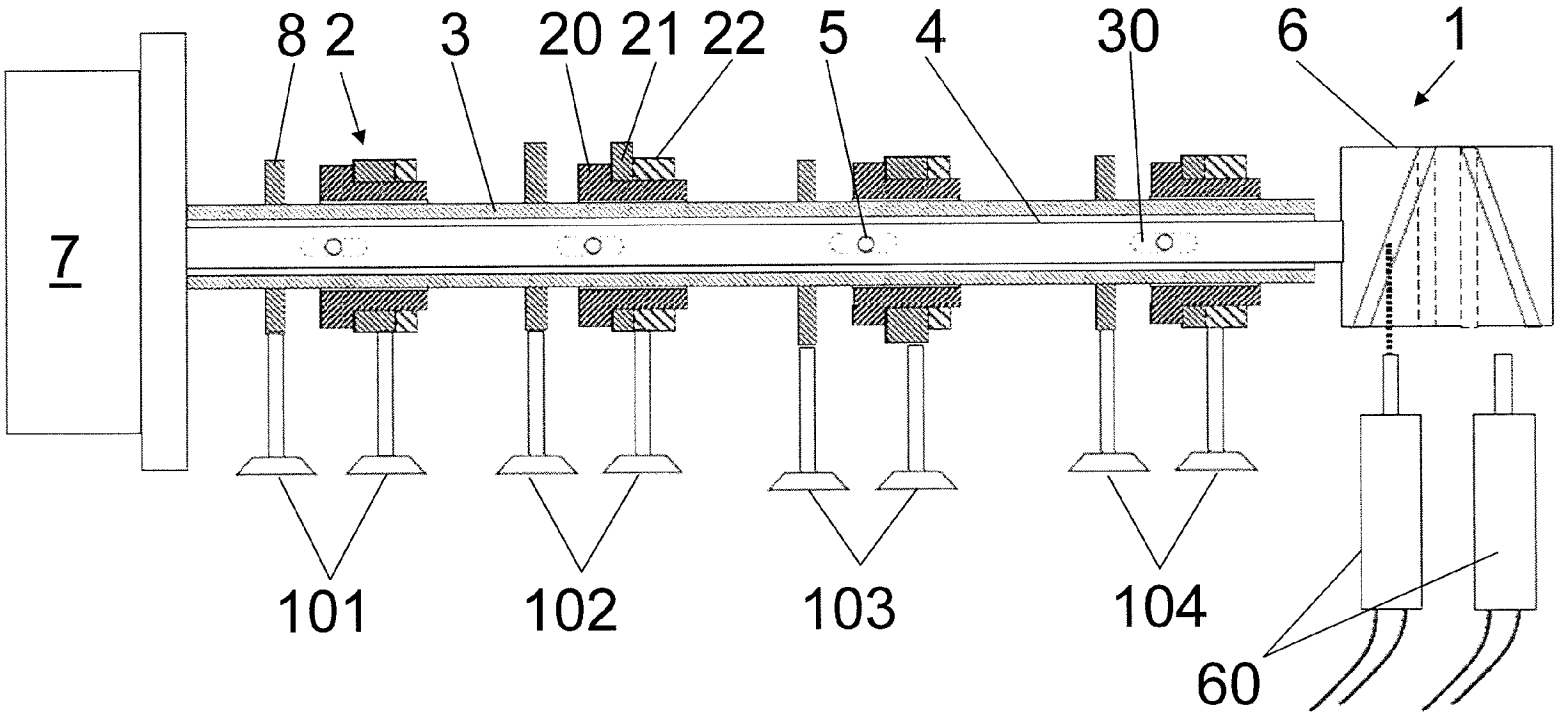
FIG. 2 shows the camshaft of FIG. 1 at a second point in time.

The drawing in FIG. 2 shows the state wherein one valve of the second cylinder 102 and one valve of the fourth cylinder 104 is disengaged—they are each connected with the second cam 22—and wherein likewise one valve each for the first 101 and the third cylinders 103 will be disengaged. As can be seen, the shaft 3 and the adjusting element 4 have rotated 90°, such that at this point the grooves 30 with the contact elements 5 can be seen. In the grooves 30, the contact elements 5 have no radial play which would enable a rotation about the longitudinal axis of the camshaft 3. Other designs of the grooves 30 are addressed below.

As an alternative, other angles are also possible beside the 90° angle. The angle is dependent on the control of the valve and/or the required variant of the adjustment of the camshaft 1. As indicated, the actuator 60 is disposed in another region of the track in the axial adjustment device 6. In this position, the valves of the third cylinder 103 are being controlled by the camshaft 1. This means that at this moment, no adjustment of the cams for the valves of the first 101 and third cylinders 103 is taking place. This is realized in that the adjusting element 4 is not axially displaced at the point in time illustrated here, after the state shown in FIG. 1.

Figure 3:
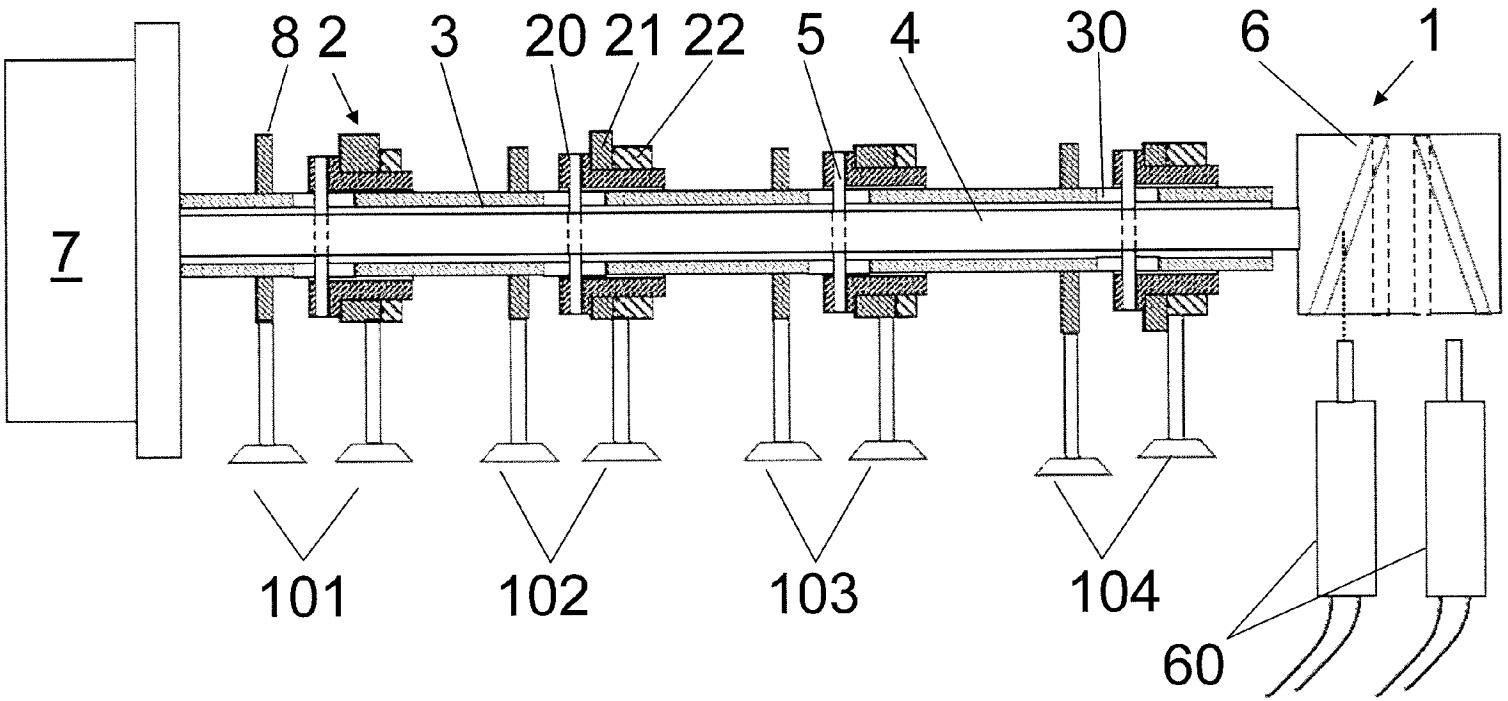
FIG. 3 shows the camshaft in FIG. 1 at a third point in time.

In FIG. 3, the shaft and the adjusting element 4 have rotated a further 90°. The adjusting element 4 in this case is still at the same axial position as in FIG. 2. As can be seen, the valves of the fourth cylinder 104 are being actuated by the camshaft 1, wherein one valve is not being operated. In particular, the single cam 8, the same being rigidly fixed on the shaft 3, is operating the valve—shown at left in the drawing—of the fourth cylinder 104, wherein the right valve of the fourth cylinder 104 is running on the base circle over the second cam 22 of the cam package 2, and therefore is essentially operated with a zero lift.

Figure 4:
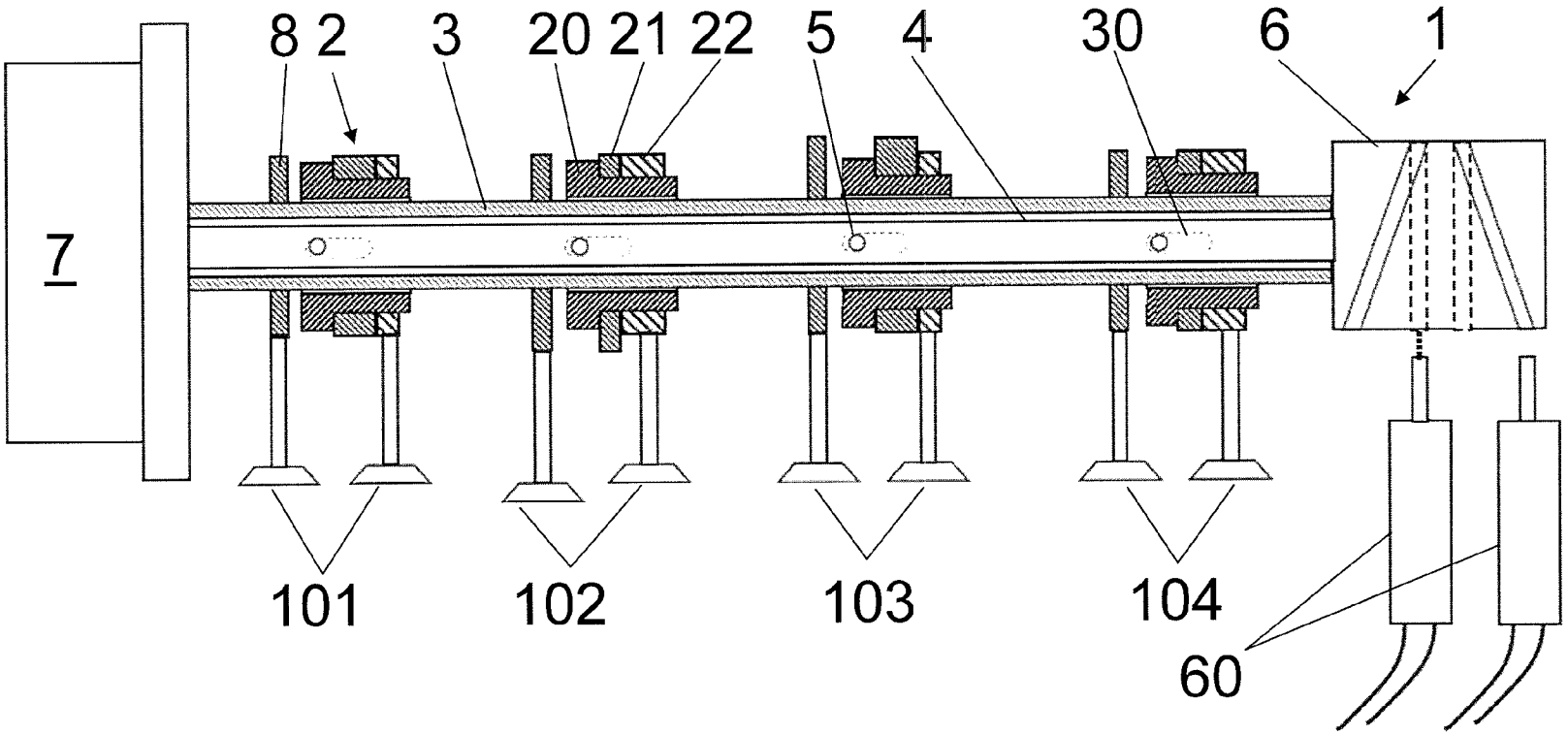
FIG. 4 shows the camshaft in FIG. 1 at a fourth point in time.

In FIG. 4, there has been a further 90° rotation relative to the state illustrated in FIG. 3, and the adjusting element 4 is axially displaced to such an extent that the corresponding valves of the first cylinder 101 and the third cylinder 103 come into contact with the narrower second cam 22 of the cam package 2 assigned to the same in each case. In this example, this means that the valves of the first 101 and third cylinders 103 are also disengaged, according to the outer contour of the second cam 22 of the associated cam package 2, because they are running on the base circle—in other words with a lift of zero. The actuator 60 has arrived at this point at the end of the track, and no further axial displacement of the adjusting element 4 takes place.

Figure 5:
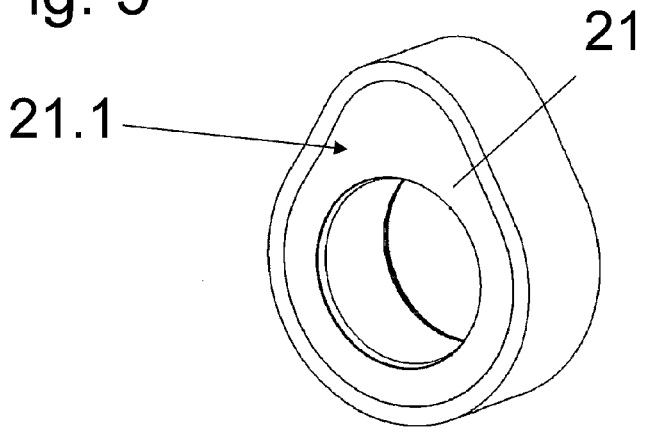
FIG. 5 shows a spatial drawing of a cam.

FIG. 5 illustrates a first cam 21 by way of example, as attached on a slot of a cam package. In an alternative—and not illustrated—embodiment, the cam 21 is a hollow cam which substantially only has an outer contour and an attachment surface for the slots. In a further embodiment, the cam is a part of the slot itself. The base circle and the nose or point 21.1 can be seen.

Figure 6:
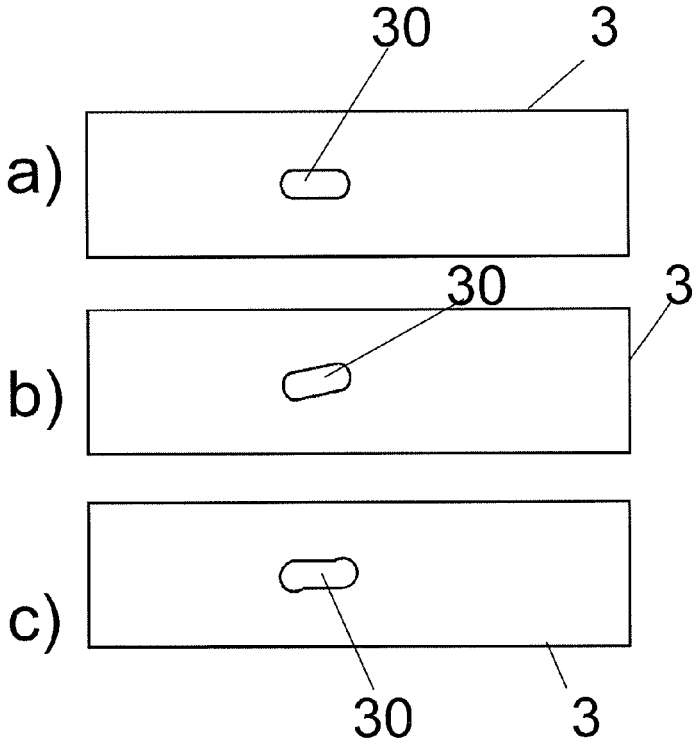
FIGS. 6 *a*) to *c*) show top views of three variants of a groove in the shaft.

FIG. 6 illustrates three variants *a*) to *c*) for the design of a groove 30 in the shaft 3. In the first variant in FIG. 6 *a*), the torque can be transmitted via the groove 30 or via the inner shaft. In the design shown in FIG. 6 *b*), the groove 30 is tilted, and the contact element is fixed in the end position. The S-shaped design shown in FIG. 6 *c*) likewise enables a fixing of the contact element at the end points of the axial movement.

Figure 7:
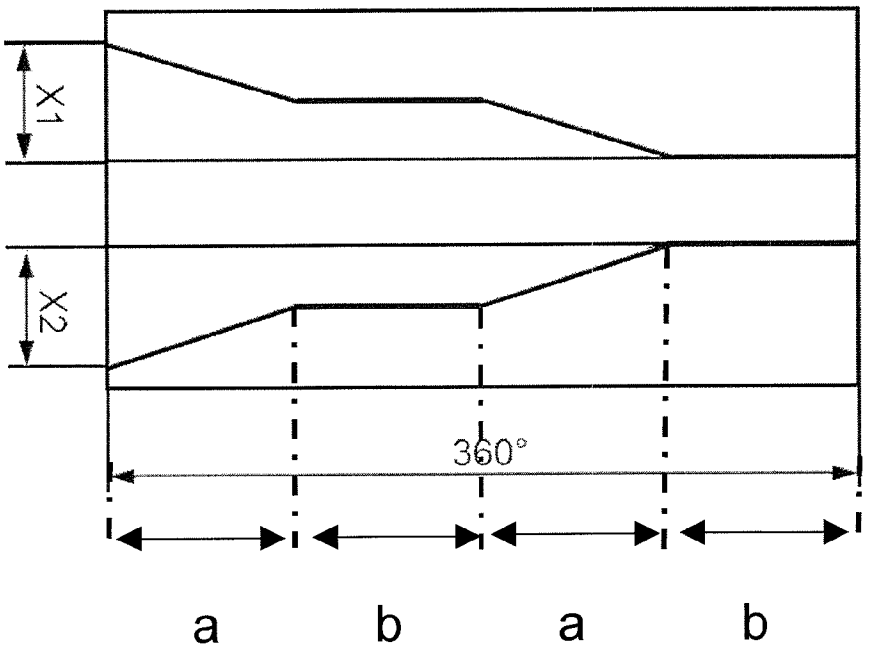
FIG. 7 shows an uncoiled pathway of an axial adjusting device.

FIG. 7 shows a possible track via which an actuator displaces the adjusting device axially by a distance X1 and/or, in the opposite direction, X2. In this case, the unrolled 360° outer surface of, for example, a wheel, is illustrated as a part of the axial adjusting device. In this case, substantially two displacements occur, which initially result in—in the above example shown in FIGS. 1 to 4 as an exemplary implementation of the possibilities afforded by the invention—a disengagement of the valves of the second and fourth cylinders, and then the valves of the first and third cylinders (segment a). A segment (segment b in the figure) is included between these two disengagements, which does not result in any axial displacement of the adjusting element. The two illustrated tracks in this case are constructed symmetrical to each other, matching the arrangement of the actuators in FIGS. 1 to 4, wherein one track results in the displacement in the first direction, and the other track results in the displacement in the other direction.

The symmetrical construction in this case is the result of the fact that the actuators are arranged next to each other. The shape of the tracks is therefore also dependent on how the axial adjusting device is designed, and/or how the actuators are arranged and initiate the displacement. The total of four segments a, b in this case each correspond to an angular measure of 90°, corresponding to the illustrations in FIGS. 1 to 4. However, other angles are also possible, particularly in the case of other numbers of cylinders. In one embodiment, both angles for the displacement of the cams—both segment a—and both angles when no displacement is occurring—indicated by b—are each identical and different from each other. The number of the angles and their sizes in this case also depends on the number of the displacements, meaning on the number of the cam packages affected.

Figure 8:
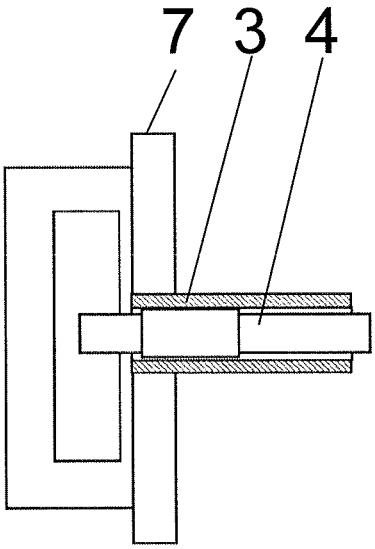
FIGS. 8 *a*) and *b*) show cutaway views of two variants of the connection between the adjusting element and the radial rotation device.
Figure 8:
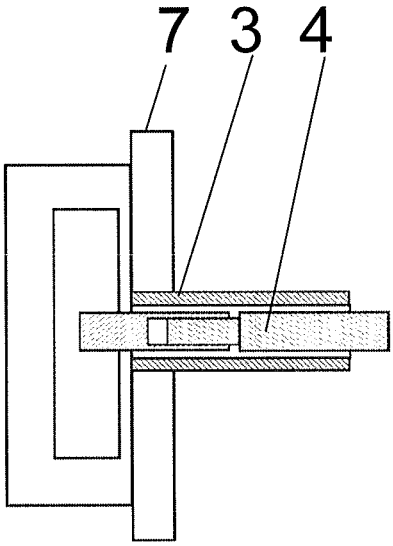

In the drawings in FIG. 8 *a*) and *b*), two variants are illustrated for the design of the radial rotation device 7. The radial rotation device 7 in this case is connected to the adjusting element 4, and enables the rotation thereof with respect to the outer shaft 3, and therefore enables the modification of the phase of the cams. Both variants differ from each other with regard to the implementation of a longitudinal compensation, which is necessary due to the axial displacement of the adjusting element 4. In the variant shown in FIG. 8 *a*), a special element is included for this compensation, whereas in the variant shown in FIG. 8 *b*), the compensation is carried out via an inner and an outer toothing of two element components of the adjusting element 4. As an alternative, balls can be used which run in races between the segments of the elements, said segments being disposed inside each other, and which function in a manner corresponding to that of a longitudinal compensating element in articulated shafts.

Figure 9:
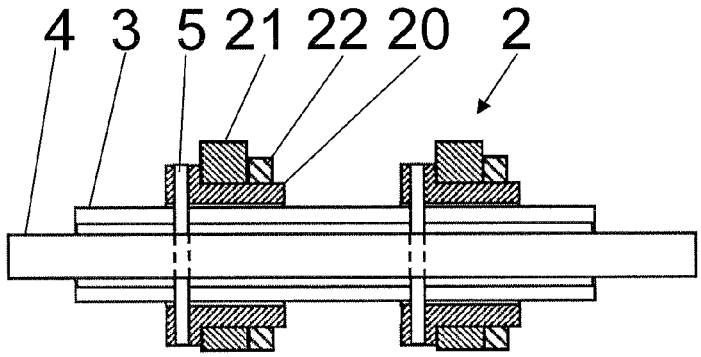
FIGS. 9 *a*), *b*), and *c*) show three cutaway views of a further embodiment of the camshaft.
Figure 9:
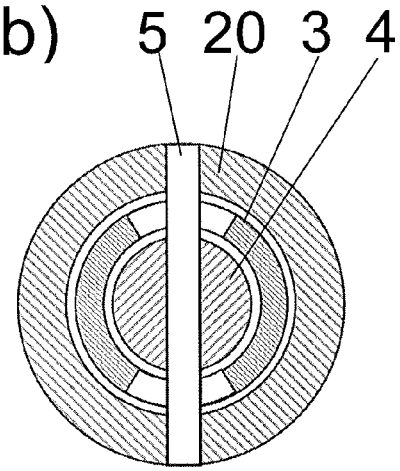
Figure 9:
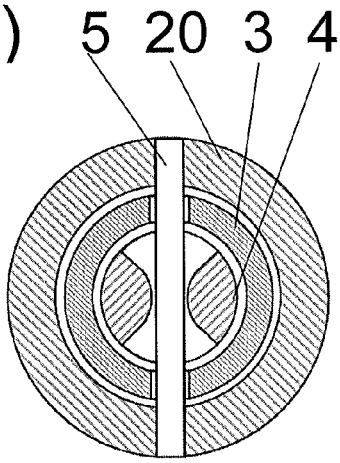
Figure 10:
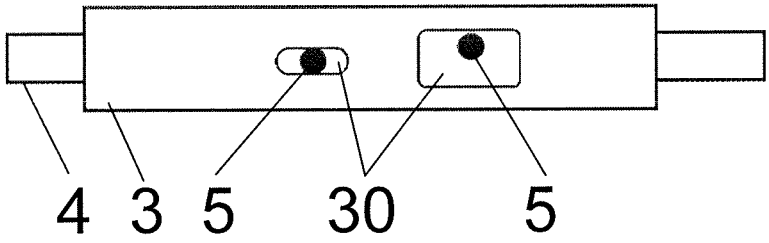
FIG. 10 shows a top view of a shaft having two different grooves.

FIG. 9 *a*) illustrates a part of a camshaft having two neighboring cam packages 2 which both enable a modification of the lift (via a different cam contour of the first 21 and the second cams 22) and a phase modification (rotation about the longitudinal axis of the shaft 3). In the drawing in FIG. 9 *b*) and FIG. 9 *c*), two cutaway views are shown of the shaft 3 at different positions. The constructions in the shaft 3 enable both an axial guidance of the contact elements 5, and also a radial mobility at the same time, as well as an axial guidance alone, meaning with a fixed radial orientation. FIG. 10 shows a part of a camshaft having a shaft 3 with two different grooves 30 for the contact elements 5. In the variant illustrated on the left, only one axial displacement is possible, and the groove—located at the right in the illustration—also enables a radial rotation because the contact element 5 has lateral space in the groove 30.

Figure 11:
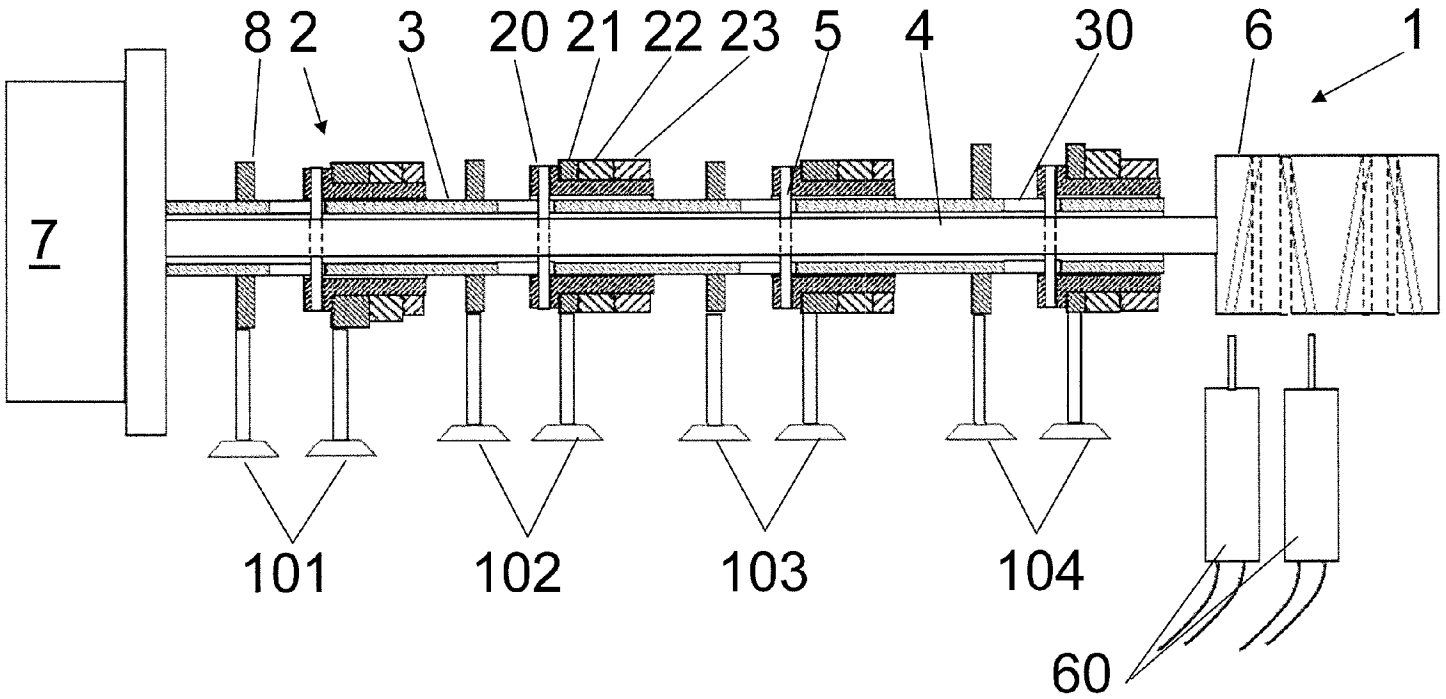
FIG. 11 shows a cutaway view of a further variant of the camshaft.

The camshaft 1 in FIG. 11 enables switching between three different contours, because each cam package 2 has three different cams: the first cam 21, the second cam 22, and the third cam 23. As such, it is possible to use three different profiles for the control of the valves. The different valve lifts in this case can be seen by the different heights of the cams of the cam packages 2 for the valve of the first cylinder 101. In order to enable the displacements of the three different cams 21, 22, 23, the axial adjusting device 6 in this case also has two tracks—also shown schematically—such that a displacement of the first cam 21 with respect to the second cam 22, and of the second cam 22 with respect to the third cam 23, is possible. For the return movement, two tracks are accordingly included, which in this case are designed as symmetric. In addition, different numbers of cams and/or cam contours can be included for each valve.

Figure 12:
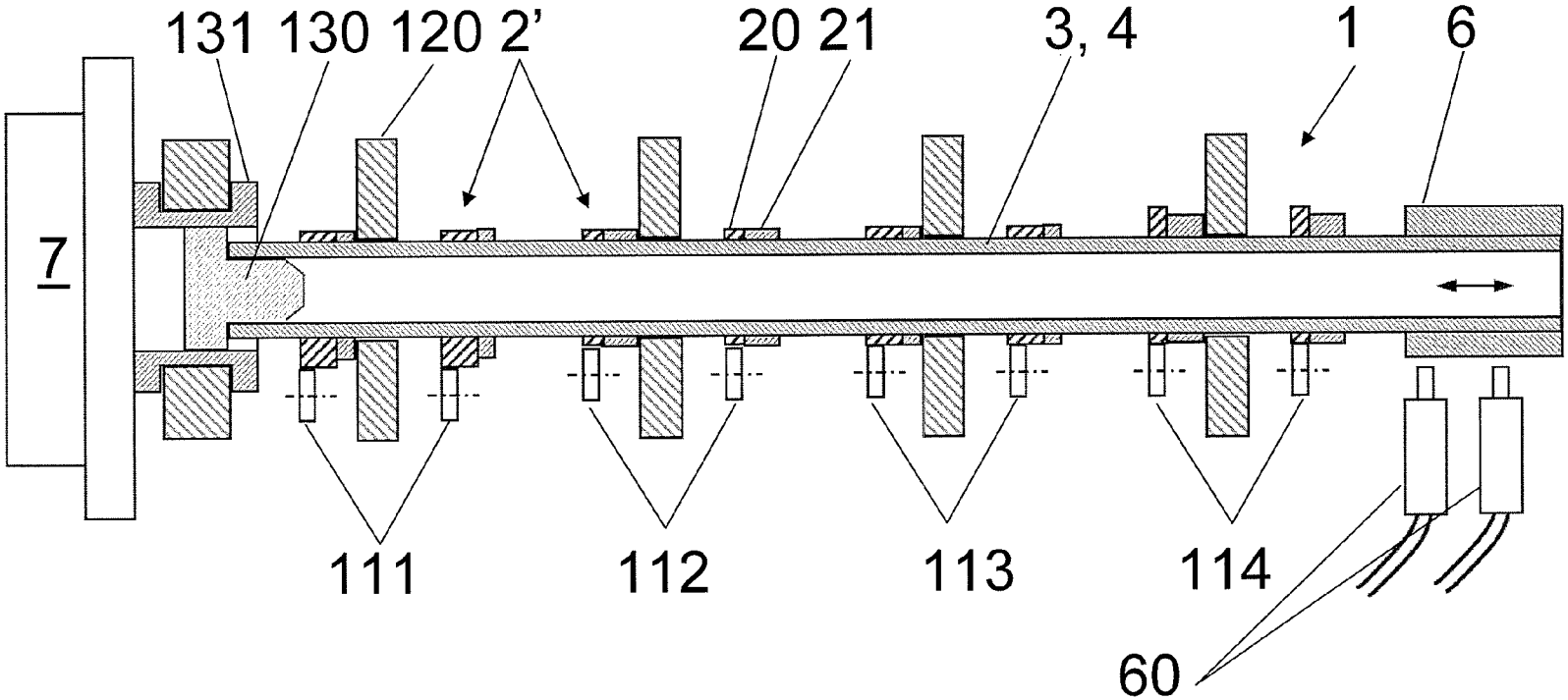
FIG. 12 shows a cutaway view of a further variant of the camshaft, having a first type of connection between the shaft and the housing.

In the case of the camshaft 1 shown in FIG. 12, the shaft 3 and the adjusting element 4 form a unit which is designed and arranged to be able to slide axially, and which also serves to transmit torque. In this embodiment, therefore, the cam packages 2' are rigidly fixed to the shaft 3 and/or to the adjusting element 4. The cam packages 2' in this illustration each come into contact with a roller tappet, wherein two roller tappets are included for each cylinder, for the two valves thereof: the roller tappets of the first cylinder 111, the roller tappets of the second cylinder 112, the roller tappets of the third cylinder 113, and the roller tappets of the fourth cylinder 114. In addition, the bearings 120 on which the camshaft 1 rests when assembled are indicated. The shaft 3 and/or the adjusting element 4 are displaced axially via the axial adjusting device 6 and the actuators 60 (indicated by the double arrow).

Because the cam packages 2' are rigidly fixed on the shaft 3, the roller tappets 111, 112, 113, 114 therefore also come into contact with the different cams 20, 21 and/or cam contours of the packages 2'. The cam packages 2' in this case can—as illustrated here—consist of individual cams 20, 21; however, they can also be a unit with corresponding, different cam contours. In addition, a radial rotation device 7 is included for the purpose of rotating the shaft 3 radially about its longitudinal axis to adjust the phase of the cams. For the purpose of transmitting torque, which is transferred by the crankshaft, for example, when the engine is assembled, a housing 131 is included in this case, wherein a stopper 130 is arranged in said housing 131, and is able to move axially over the toothing, for example. In contrast, the stopper 130 itself is fixed in the rotational plane, for example connected to the shaft 3 via an interference fit.

As an alternative, the axial adjustment between the stopper 130 and the housing 131 is carried out as a result of the axial displacements of the shaft 3, by means of a corresponding inner toothing. The housing 131 in this case is mounted axially. The camshaft 1 in FIG. 13 differs from the variant shown in FIG. 12 in that the shaft 3 is directly coupled to the housing 131, for example via a corresponding toothing which enables the axial displacement. An axial displacement in this case is likewise possible by means of balls which are situated in raceways between the shaft 3 and the housing 131.

Figure 13:
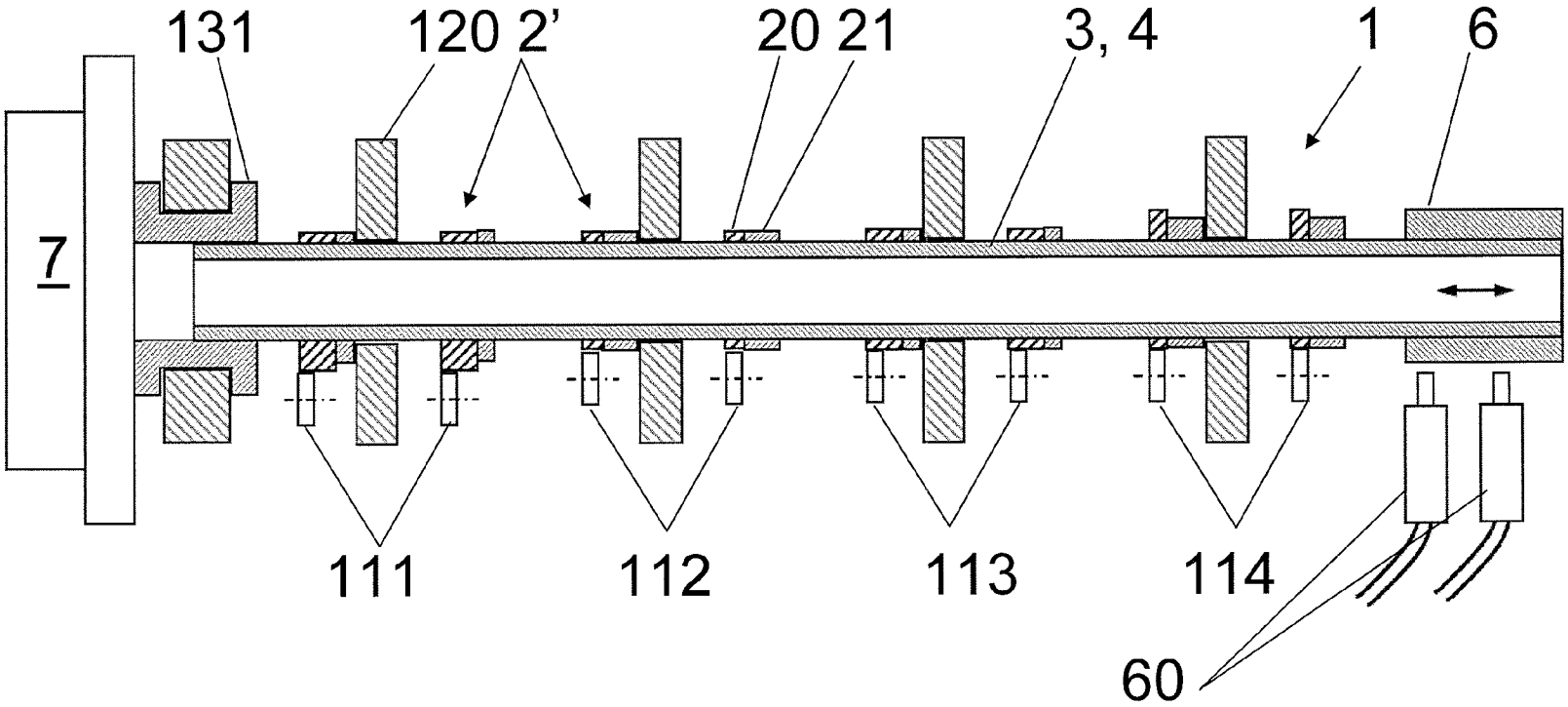
FIG. 13 shows a cutaway view of an embodiment of the connection between the shaft and the housing, which is an alternative to the variant shown in FIG. 12.

The variants of the camshaft 1 of FIG. 12 and FIG. 13 only enable the displacement of all cam packages 2' at the same time, because all cam packages 2' are rigidly connected to the shaft 3 and/or to the adjusting element 4, which is identical to the shaft 3. Displacement occurring while a cam is operating a valve, meaning outside the base circle, is possible in this case by means of the different widths of the cams 21, 22. The variants in FIGS. 1 to 4, and FIG. 11 also make it possible for fewer than all of the cam packages to be displaced by means of the adjusting element 4 in connection with the shaft 3, because the cam packages are rigidly connected to the adjusting element 4, which is different from the shaft 3 in these embodiments. This possibility, of preventing the displacement of single cams, enables the use of single cams 8 which are not altered—for example in the variant shown in FIG. 1.

Figure 14:
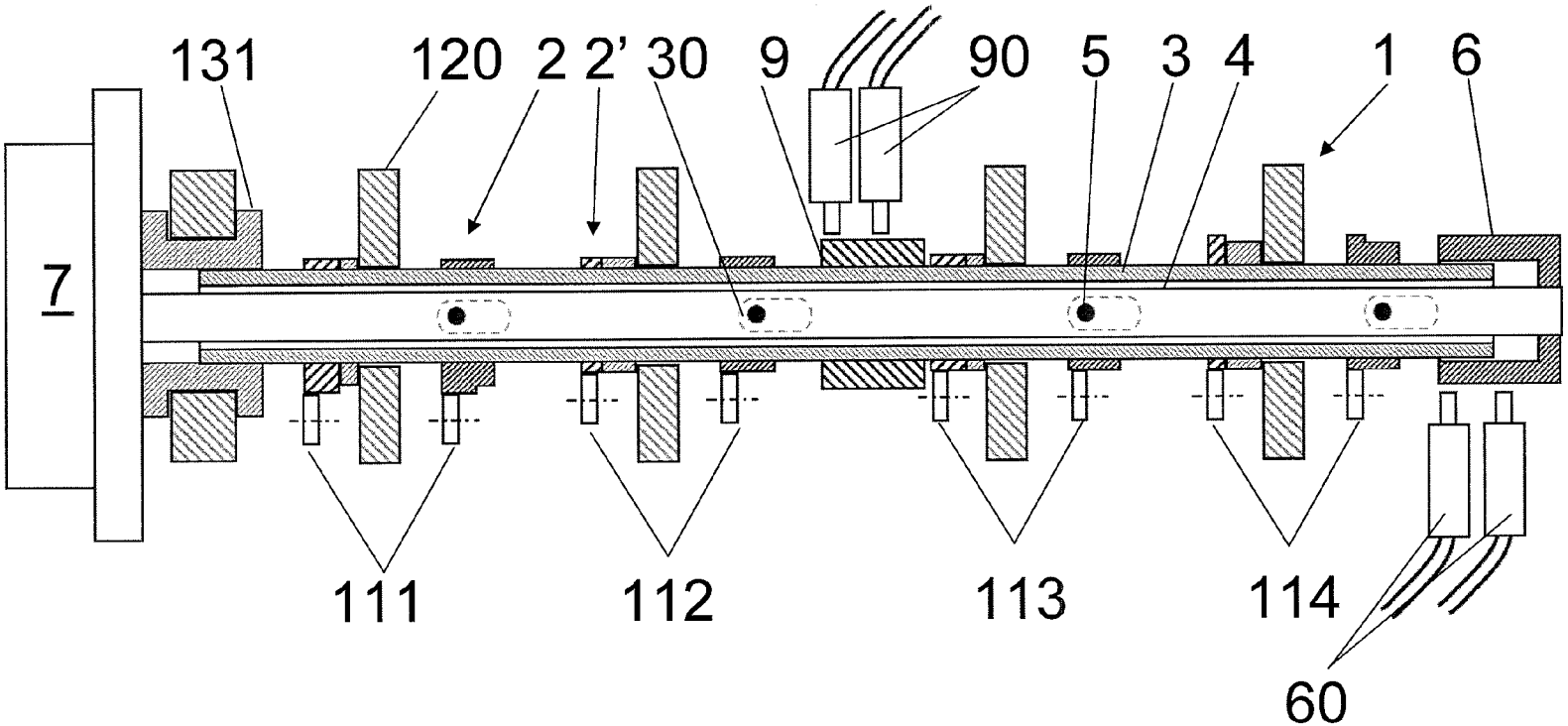
FIG. 14 shows a cutaway view of an additional embodiment of the camshaft of the invention.

The variant shown in FIG. 14 makes it possible to control the two valves of every cylinder with different combinations of cam contours. For this purpose, one cam package 2' per valve is connected to the shaft 3, and a cam package 2 is connected to the adjusting element 4 via the contact element 5, through the groove 30. As such, two separate systems are used for the adjustment of the camshaft 1. The adjusting element 4 in this case is displaced axially by the axial adjusting device 6 and the actuators 60, and the tube 3 is displaced by the additional axial adjusting device 9 and their actuators 90 assigned thereto.

In order to further enable a radial rotation device 7 on the other end of the camshaft 1, and therefore the radial rotation of the cams with respect to each other, the additional axial adjusting device 9 in this case is attached laterally in the illustrated example. In this example as well, the crankshaft—which is not illustrated here—is able to drive the camshaft 1 via a chain—which is likewise not illustrated—for example. The cam packages 2 which are displaced by means of the adjusting element 4, are each one unit in this embodiment, which accordingly has two different cam contours. The adjustment of a cam during the operation of the associated valve by said cam is likewise enabled by the cam contour of matching width.

Figure 15:
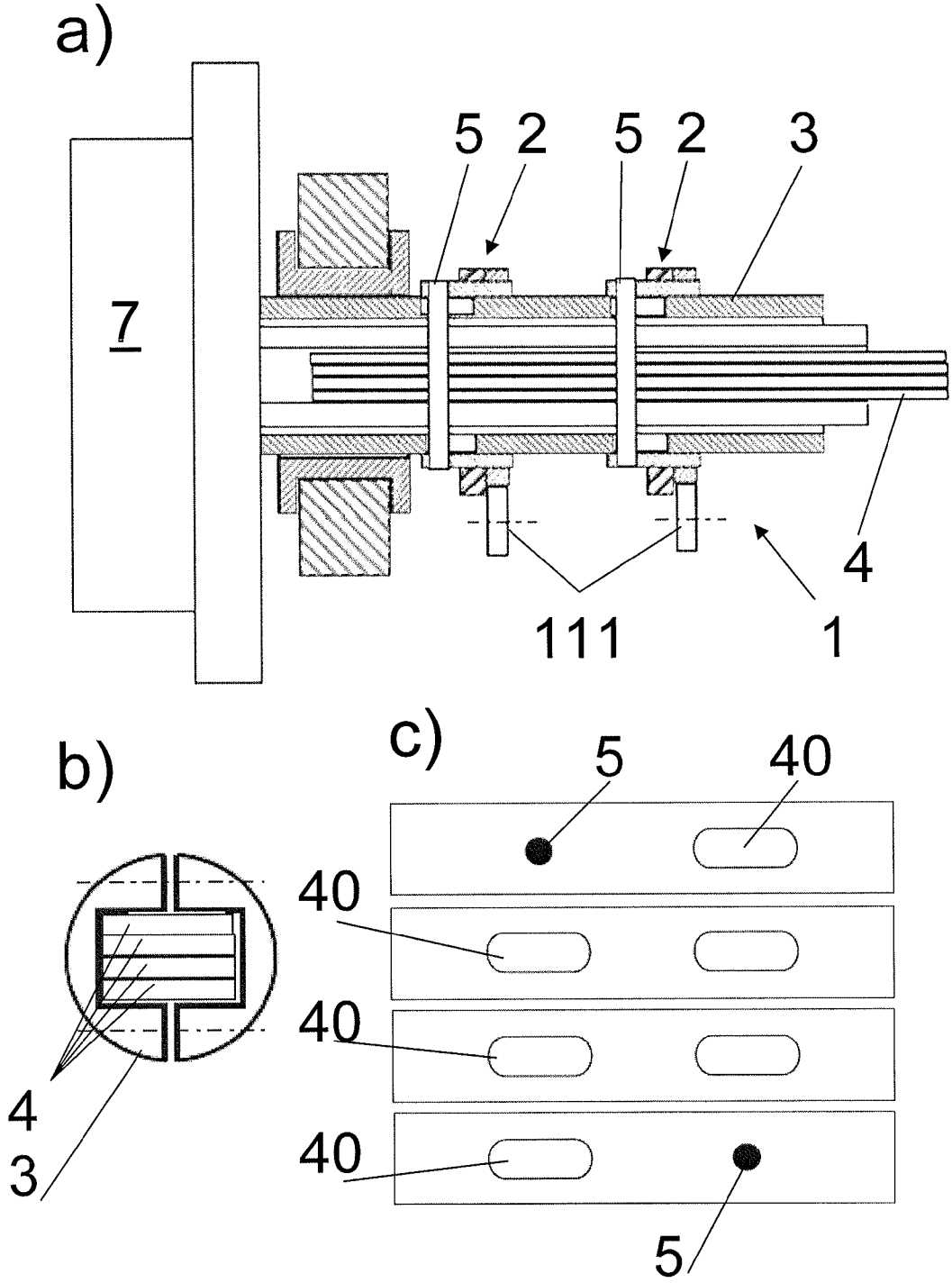
FIGS. 15 *a* to *c*) show two cutaway views of a complementary embodiment of the camshaft, as well as top views of the segments of the adjusting elements of the complementary embodiment.

FIG. 15 *a*) illustrates a segment of a further variant of the camshaft 1. In this case, it is possible to form four groups of cam packages 2, for example of different sizes, which can be adjusted at the same time. For this purpose, four adjusting elements 4 are situated in the shaft 3, and are each connected to the individual cam packages 2 via contact elements 5. The individual adjusting elements 4 in this case are designed in the form of support strips arranged on top of each other, for example, as shown in FIG. 15 *b*), for example. By way of example, the shaft 3 has a rectangular, free region in its interior for this purpose, wherein at least one slot, or in general one recess, for the contact elements 5, connects to each of the longitudinal surfaces of said region, wherein said contact elements 5 are designed in this case as pins, by way of example.

As an alternative, different fixing elements are disposed in an entirely hollow shaft 3, and have the interior contour described above, or otherwise provide guidance. The adjusting elements 4 have groove 40 for the displacement of the cam packages 2, in which the cam packages are arranged in this case to be able to slide axially on the shaft 3.

In the cutaway shown in FIG. 15 *a*), the individual adjusting elements 4 shown in FIG. 15 *c*) are arranged next to each other. For the two illustrated cam packages 2, the configuration includes two contact elements 5—in this case on the uppermost and the lowermost adjusting element 4—which are disposed at different axial positions. Because the contact elements 5 extend completely through the shaft 3, and therefore through all of the adjusting elements 4, the other two adjusting elements 4 each have grooves 40 situated at the elevation of the contact elements 5, and these grooves 40 enable the axial displacement of the other elements. As such, the individual adjusting elements 4 can be displaced axially independently of each other.

As an alternative, it is possible to also couple the axial movements of the individual adjusting elements 4 to each other via the grooves of the adjusting elements 40, meaning via the design and arrangement thereof. Because it is possible in this variant to specifically displace single cam packages 2, it is also not necessary, for example, for the single cams to have different widths, because the displacement can preferably occur on the base circle. However, a combination is also possible for the purpose of optionally meeting special requirements for the adjustment of the camshaft 1.

The variant shown here makes it is possible to form four groups of cam packages, and it is also possible to separately control even single cam packages. In addition, another number of groups is possible, whereby optionally the number of the individual adjusting elements 4—which adjusting elements are constructed as flat in this case—must be reduced or increased. The variant of the adjusting elements 4 shown in FIG. 15 can also be combined accordingly with the variants above, for example, in the event that one valve should be displaced separately, but the others should be displaced in groups.

Figure 16:
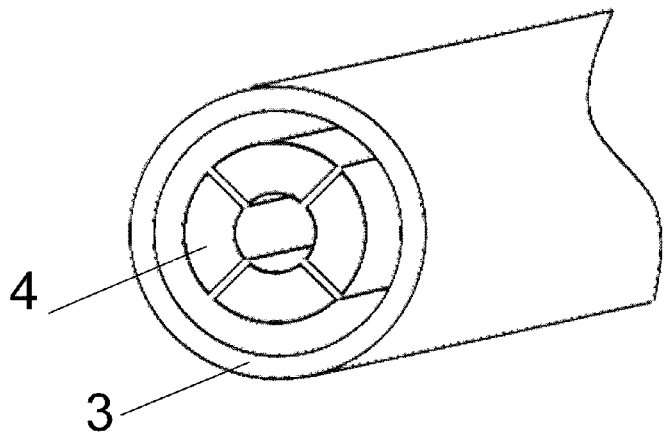
FIG. 16 shows a schematic, spatial illustration of a further variant of the adjusting element, and FIGS. 17 *a*) and *b*) show two cutaway views through possible states for the radial rotation of the adjusting elements in FIG. 16.

As an alternative or as a complement to the sheet metal or strip-like adjusting elements 4, tubes can also be arranged inside each other, for example in a telescoping manner. The adjusting element 4 in FIG. 16 also enables the realization of multiple groups of cam packages which are operated simultaneously. In this case, an adjusting element 4 is included inside the shaft 3, and consists of four segments in this example, wherein said segments can be axially displaced individually.

Figure 17:
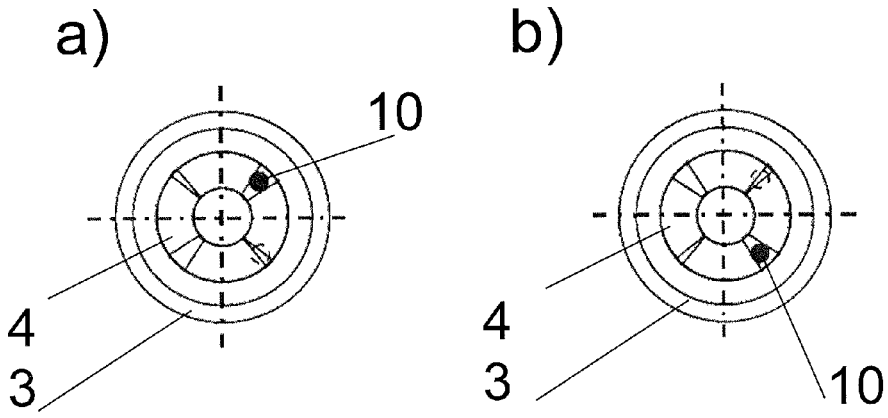

The drawing in FIGS. 17 *a*) and *b*) show a possible radial rotation of the individual segments, and therefore of each of the cam packages connected thereto. In this case—in the illustrated configuration—two segments lying opposite each other can each be adjusted radially with respect to each other, because a free space exists between the neighboring segments, wherein—in this embodiment—a fixing element 10 is inserted into said free space. The number of the segments can accordingly be adjusted to the existing requirements, and/or to the number of the cylinders.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. An adjustable camshaft comprising:

at least one shaft, multiple cam packages, each cam package having at least two different cams and/or cam contours, and at least one adjusting element constructed to slide axially along a longitudinal axis of the camshaft, wherein the cams and/or cam contours of at least one of the cam packages have different widths, wherein the at least one adjusting element is mechanically coupled via at least one contact element through a groove in the at least one shaft to a first one of the multiple cam packages having cams and/or cam contours with different widths and being constructed to slide axially along the longitudinal axis of the camshaft relative to the at least one shaft, wherein the at least one shaft is constructed to slide axially along the longitudinal axis of the camshaft, wherein a second one of the multiple cam packaged is rigidly fixed to said shaft, and wherein the at least one adjusting element and the at least one shaft are constructed to allow the first one of the multiple cam packages coupled to said adjusting element and the second one of the cam packages fixed to said shaft to be moved independently of each other.

2. A camshaft according to claim 1, wherein:

at least two cam packages are mechanically coupled to the adjusting element.

3. A camshaft according to claim 1, wherein the adjusting element is constructed to rotate radially about the longitudinal axis of the camshaft.

4. A camshaft according to claim 1, wherein at least one axial adjusting device is included which is connected to the adjusting element, and which displaces the adjusting element axially, at least segmentally.

5. A camshaft according to claim 1, wherein multiple adjusting elements are included which are constructed to slide axially along the longitudinal axis of the camshaft.

6. A camshaft according to claim 1, wherein the adjusting element is constructed as a solid cylinder, or as a tube, or as a segment of a cylinder, or as a segment of a tube, or as a sheet metal part.

* * * * *